US008272514B2

(12) United States Patent
Zeng et al.

(10) Patent No.: US 8,272,514 B2
(45) Date of Patent: Sep. 25, 2012

(54) PACKING APPARATUS

(75) Inventors: Biao Zeng, Wuhan (CN); Miao He, Wuhan (CN); Zhi-Guo Zhang, Wuhan (CN); Li-Fu Xu, Wuhan (CN)

(73) Assignees: Hong Fu Jin Precision Industry (WuHan) Co., Ltd., Wuhan, Hubei Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/217,502

(22) Filed: Aug. 25, 2011

(65) Prior Publication Data

US 2012/0168330 A1 Jul. 5, 2012

(30) Foreign Application Priority Data

Dec. 31, 2010 (CN) ..... 2010 1 010617925

(51) Int. Cl.
*B65D 81/02* (2006.01)

(52) U.S. Cl. ..... 206/586; 206/593

(58) Field of Classification Search ..... 206/523, 206/586, 587, 588, 589, 590, 591, 592, 593, 206/594, 453

See application file for complete search history.

(56) References Cited

U.S. PATENT DOCUMENTS

| | | | | |
|---|---|---|---|---|
| 4,061,228 | A * | 12/1977 | Johnson | 206/454 |
| 6,382,422 | B1 * | 5/2002 | Bocek | 206/586 |
| 6,769,547 | B2 * | 8/2004 | Yu | 206/586 |
| 6,976,587 | B2 * | 12/2005 | Liverman et al. | 206/586 |
| 7,370,757 | B2 * | 5/2008 | Scheid et al. | 206/320 |
| 2004/0069679 | A1 * | 4/2004 | Miller et al. | 206/586 |
| 2006/0289332 | A1 * | 12/2006 | Hsieh et al. | 206/586 |

* cited by examiner

*Primary Examiner* — Jacob K Ackun

(74) *Attorney, Agent, or Firm* — Altis Law Group, Inc.

(57) ABSTRACT

A packing apparatus includes a case for receiving a plurality of electronic devices and a plurality of mounting members placed in the case. Each mounting member defines a receiving space. A shock-absorbing member is located in the receiving space and divides the receiving space into two mounting spaces. A shock-absorbing block is located in each mounting space. A slot is defined between the shock-absorbing block and the shock-absorbing member. A side of the shock-absorbing block towards the shock-absorbing member defines an oblique plane as a cushioning surface, and the oblique plane abuts the shock-absorbing member when the shock-absorbing member is bent.

18 Claims, 5 Drawing Sheets

PACKING APPARATUS

BACKGROUND

1. Technical Field

The present disclosure relates to packing apparatuses, and particularly to a packing apparatus for packing electronic devices.

2. Description of Related Art

A packing apparatus is used for packing an electronic device. The packing apparatus includes a plurality of cushions for securing the corners of the electronic device. Each cushion is divided into two parts by a shock-absorbing member, so that each cushion can secure two electronic devices. However, the shock-absorbing member is often knocked to pieces when the electronic devices move around.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
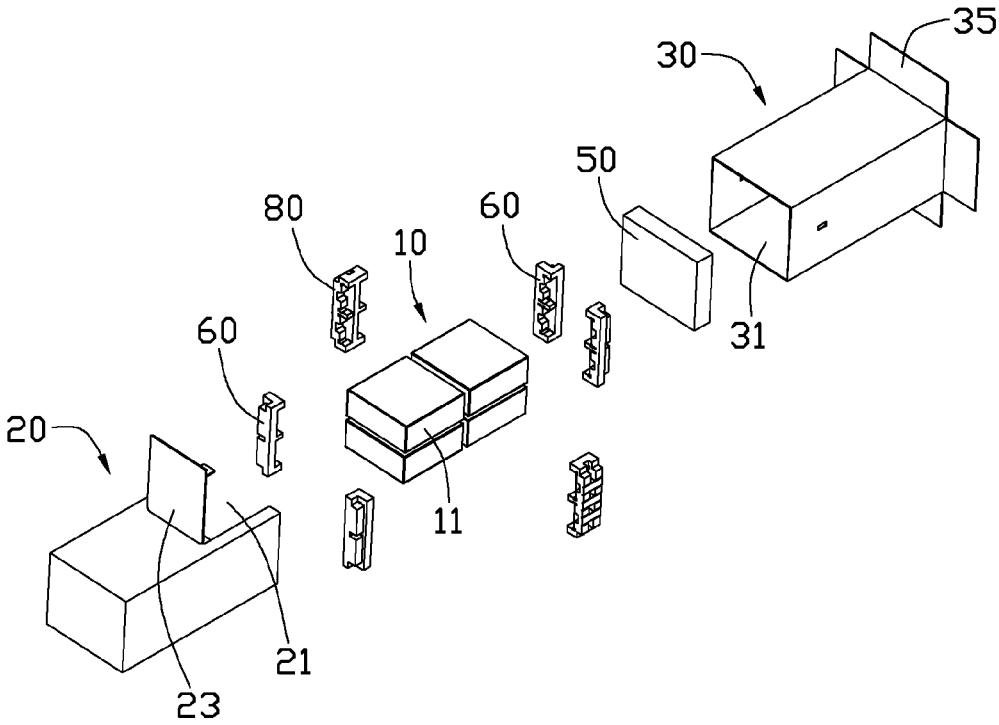
FIG. 1 is an exploded, isometric view of a packing apparatus and a plurality of electronic devices in accordance with an embodiment of the present disclosure.

Referring to FIG. 1, a packing apparatus in accordance with an embodiment includes a first case 20, a second case 30, a receiving case 50, four first mounting members 60 and two second mounting members 80. The four first mounting members 60 and the two second mounting members 80 are for mounting four electronic devices 10.

Each electronic device 10 includes two side plates 11 substantially parallel to each other.

The first case 20 defines an opening 21, and includes a flange 23 at a side of the opening 21. The flange 23 is operable to receive the electronic devices 10 through the opening 21.

The second case 30 defines a receiving opening 31 and a mounting opening (not shown) opposite to the receiving opening 31. The receiving opening 31 communicates with the mounting opening. The second case 30 extends four mounting pieces 35 from four corresponding edges around the mounting opening.

The receiving case 50 is adapted to receive a plurality of components which are peripheral to the electronic devices 10, such as a mouse, a charger, or a keyboard.

Figure 2:
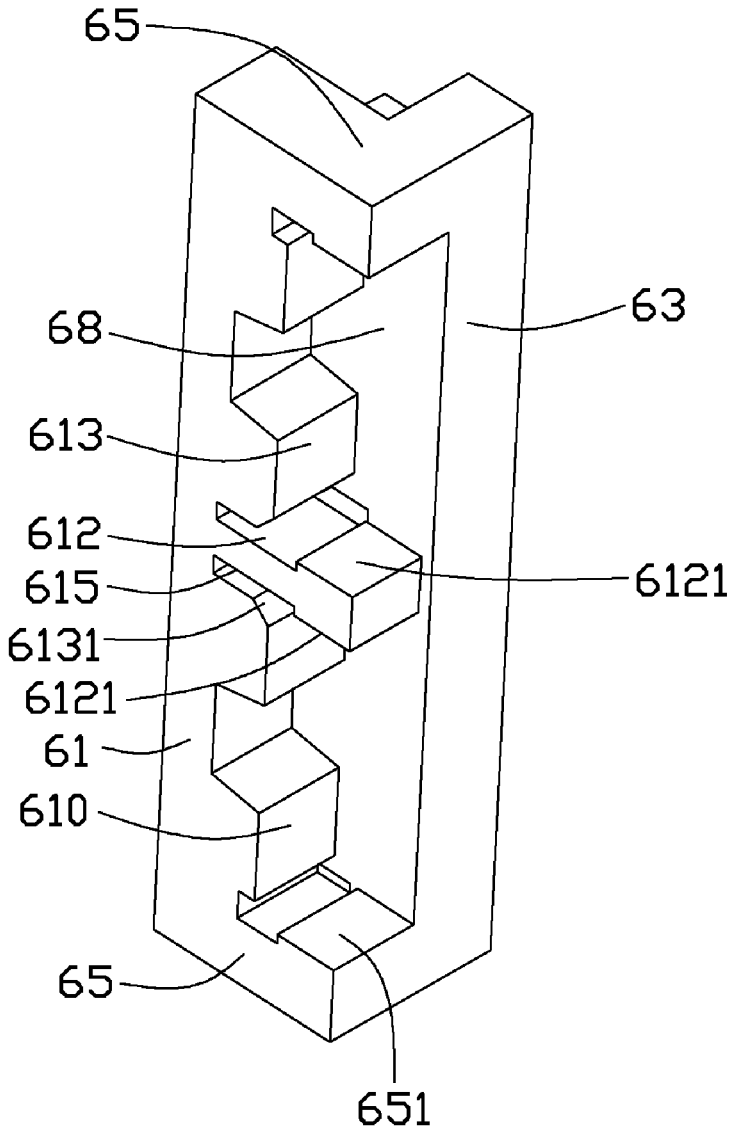
FIG. 2 is an isometric view of a first mounting member of the packing apparatus of FIG. 1.

Referring to FIG. 2, each first mounting member 60 includes a sidewall 61, a mounting wall 63 and two limiting walls 65. The mounting wall 63 is connected to the sidewall 61, and is substantially perpendicular to the sidewall 61. The two limiting walls 65 are attached to corresponding ends of the sidewall 61 and the mounting wall 63. The two limiting walls 65 are substantially parallel to each other and perpendicular to the sidewall 61 and the mounting wall 63. A receiving space is cooperatively defined by the sidewall 61, the mounting wall 63 and the two limiting walls 65. A shock-absorbing member 612 extending from the sidewall 61 is located in the receiving space. The shock-absorbing member 612 divides the receiving space into two mounting spaces 68. The shock-absorbing member 612 is connected to the sidewall 61 and the mounting wall 63. A first shock-absorbing block 613 and a second shock-absorbing block 610 are located in each mounting space 68, and extend from the sidewall 61. The first shock-absorbing block 613 is adjacent to the shock-absorbing member 612. The shock-absorbing blocks 613 in the two mounting spaces 68 are symmetrically located at two opposite sides of the shock-absorbing member 612. The second shock-absorbing block 610 is adjacent to a corresponding limiting wall 65. A first pressing block 651 extends from each limiting wall 65 towards the other limiting wall 65. A second pressing block 6121 extends from each side surface of the shock-absorbing member 612 towards each limiting wall 65. Each first shock-absorbing block 613 defines a limiting plane 6131 arranged on the corner of the block 613 nearest the shock-absorbing member 612. The limiting plane 6131 forms a bevel or chamfer. An angle defined between the limiting plane 6131 and the side surface of the shock-absorbing member 612 towards the shock-absorbing block 613 is acute. A slot 615 is defined between each first shock-absorbing block 613 and the shock-absorbing member 612. The slot 615 extends to the sidewall 61.

The second mounting member 80 is composed of two first mounting members 60 sharing one mounting wall 63. Alternatively, the two first mounting members 60 of the second mounting member 80 each includes one mounting wall 63, the two mounting walls 63 are abutting against each other.

Figure 3:
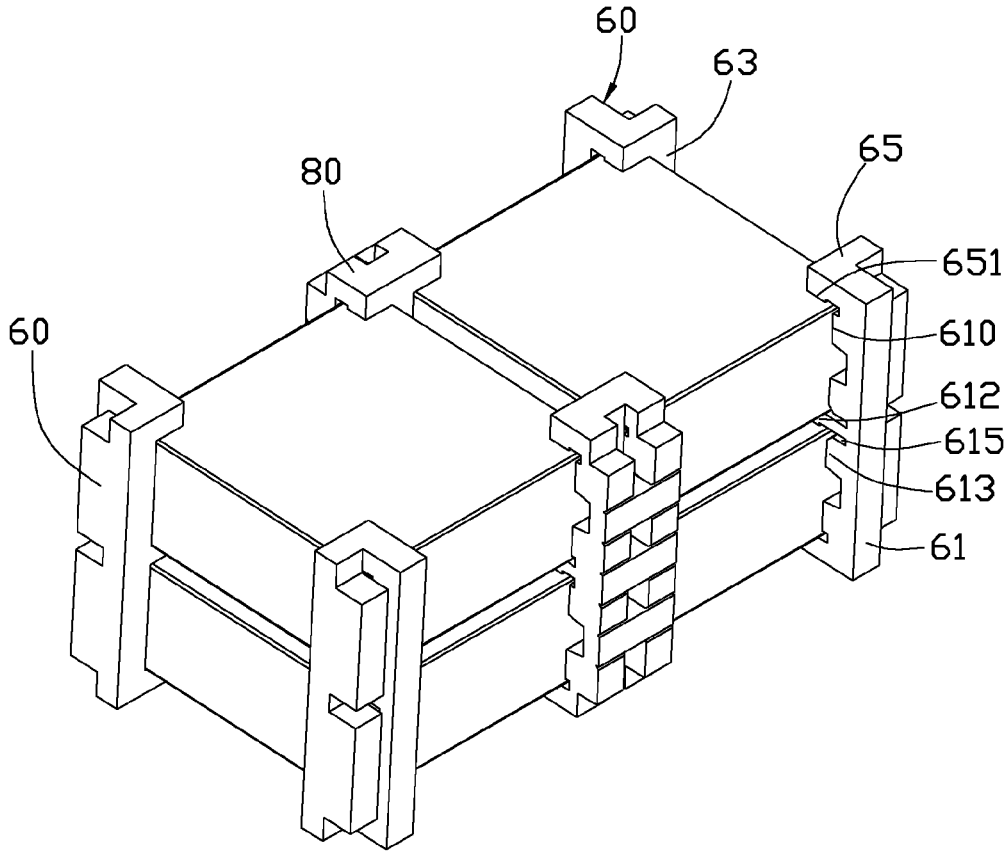
FIG. 3 is an isometric view of the plurality of electronic devices, a plurality of first mounting members and two second mounting members of the packing apparatus of FIG. 1 all assembled.
Figure 4:
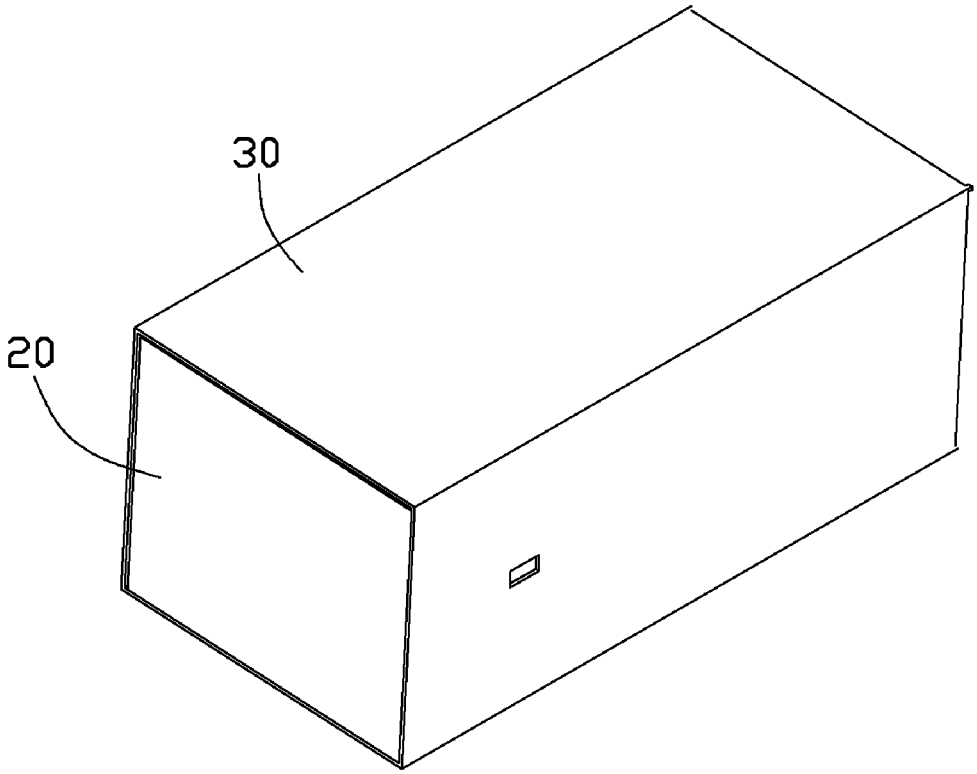
FIG. 4 is an isometric view of the assembled packing apparatus of FIG. 1.

Referring to FIG. 3 and FIG. 4, in assembly, the flange 23 of the first case 20 is bent outward, the two first mounting members 60 are placed in two parallel corners of the bottom end of the first case 20. Two electronic devices 10 are placed in the first case 20, two adjacent corners of each electronic device 10 are engaged in the mounting spaces 68 of the two first mounting members 60. The two second mounting members 80 are placed in the first case 20, and secure the other two adjacent corners of each electronic device 10 into the mounting spaces 68 of the two second mounting members 80. The two adjacent corners of each of another two electronic devices 10 are engaged in mounting spaces 68 of the two second mounting members 80. Another two first mounting members 60 are placed in the first case 20, and secure the other two adjacent corners of each of two more electronic devices 10 into the mounting spaces 68 of the two first mounting members 60. The first pressing blocks 651, the second pressing blocks 6121 and the first shock-absorbing blocks 613 abut the electronic devices 10. Two electronic devices 10 are sandwiched between the two first mounting members 60 and the two second mounting members 80. The flange 23 of the first case 20 is closed between two limiting wall 65 of the another two first mounting members 60. The first case 20 is received in the second case 30 via the receiving opening 31 of the second case 30. The receiving case 50 is positioned on the anther two first mounting members 60 in the second case 30. The second case 30 is secured to the first case 20 by a mounting method, such as latching. The mounting pieces 35 of the second case 30 are enveloped.

Figure 5:
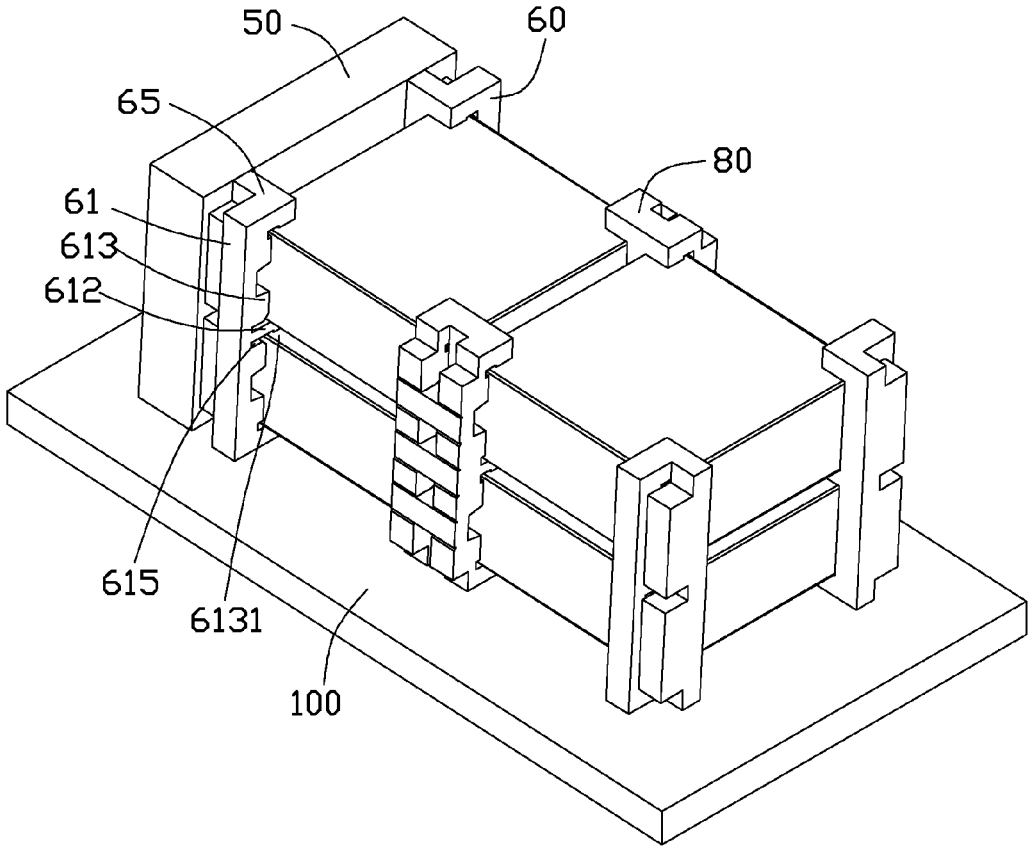
FIG. 5 is similar to FIG. 3, but showing the packing apparatus after a fall to the ground.

Referring to FIG. 5, in use, when the packing apparatus with the electronic devices 10 falls to the ground 100, the electronic device 10 above the shock-absorbing member 612 compresses the shock-absorbing member 612. The shock-absorbing member 612 is elastically deformed and is bent towards the slot 615. When the shock-absorbing member 612 is bent towards the first shock-absorbing block 613, all of the surface of the limiting plane 6131 meets the shock-absorbing member 612 and acts as a limit against further movement. The limiting plane 6131 provides support against the shock-absorbing member 612 overbending, and thus prevents the shock-absorbing member 612 being broken.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and the arrangement of parts within the principles of the disclosure, to the full extent indicated by the broad general meaning of the terms in which the appended claims are expressed.

What is claimed is:

1. A packing apparatus comprising:

a case for receiving a plurality of electronic devices; and a plurality of mounting members placed in the case, and each mounting member defining a receiving space; each of the mounting members comprising:

a shock-absorbing member formed in the receiving space, and dividing the receiving space into two mounting spaces for mounting two electronic devices; and a shock-absorbing block locating in each mounting space, a slot being defined between the shock-absorbing block and the shock-absorbing member, the shock-absorbing block defining an oblique plane towards the shock-absorbing member, the oblique plane abutting against the shock-absorbing member when the shock-absorbing member is bent.

2. The packing apparatus of claim 1, wherein the shock-absorbing blocks in the two mounting spaces are symmetrically located at two opposite sides of the shock-absorbing member.

3. The packing apparatus of claim 1, wherein an angle defined between the oblique plane and a side surface of the shock-absorbing member towards the shock-absorbing block is acute.

4. The packing apparatus of claim 1, wherein the mounting member comprises a sidewall, a mounting wall connecting the sidewall and two limiting walls at corresponding ends of the sidewall and the mounting wall, the sidewall, the mounting wall and the limiting walls cooperatively defining the receiving space.

5. The packing apparatus of claim 4, the mounting wall is connected and substantially perpendicular to the sidewall, and the two limiting walls run substantially parallel and are perpendicularly attached with the sidewall and the mounting wall.

6. The packing apparatus of claim 4, wherein the shock-absorbing block and the shock-absorbing member extend from the sidewall and are connected to the mounting wall.

7. The packing apparatus of claim 4, wherein the slot extends to the sidewall.

8. The packing apparatus of claim 4, wherein each of the limiting walls extends a first pressing block towards the shock-absorbing member for abutting against the electronic devices.

9. The packing apparatus of claim 4, wherein the shock-absorbing member comprises two opposite sides thereof each extending a second pressing block, and the second pressing block being for abutting against the electronic devices.

10. A packing apparatus comprising:

a mounting member defining a receiving space, a shock-absorbing member locating in the receiving space, and dividing the receiving space into two mounting spaces; each mounting space being for mounting a corner of an electronic device; a shock-absorbing block locating in each mounting space, a slot being defined between the shock-absorbing block and the shock-absorbing member, the shock-absorbing block defining an oblique plane towards the shock-absorbing member; the oblique plane abutting against the shock-absorbing member when the shock-absorbing member is bent.

11. The packing apparatus of claim 10, wherein the shock-absorbing blocks in the two mounting spaces are symmetrically located at two opposite sides of the shock-absorbing member.

12. The packing apparatus of claim 10, wherein an angle defined between the oblique plane and a side surface of the shock-absorbing member towards the shock-absorbing block is acute.

13. The packing apparatus of claim 10, wherein the mounting member comprises a sidewall, a mounting wall connecting the sidewall and two limiting walls at corresponding ends of the sidewall and the mounting wall, the sidewall, the mounting wall and the limiting walls cooperatively defining the receiving space.

14. The packing apparatus of claim 13, wherein the mounting wall is connected and substantially perpendicular to the sidewall, and the two limiting walls run substantially parallel and are perpendicularly attached with the sidewall and the mounting wall.

15. The packing apparatus of claim 13, wherein the shock-absorbing block and the shock-absorbing member extend from the sidewall and are connected to the mounting wall.

16. The packing apparatus of claim 13, wherein the slot extends to the sidewall.

17. The packing apparatus of claim 13, wherein each of the limiting walls extends a first pressing block towards the shock-absorbing member for abutting against the electronic devices.

18. The packing apparatus of claim 13, wherein the shock-absorbing member comprises two opposite sides thereof each extending a second pressing block, and the second pressing block being for abutting against the electronic devices.

* * * * *